US011837131B2

(12) United States Patent
Sung et al.

(10) Patent No.: US 11,837,131 B2
(45) Date of Patent: Dec. 5, 2023

(54) DISPLAY DEVICE AND METHOD OF DRIVING THE SAME

(71) Applicant: SAMSUNG DISPLAY CO., LTD., Yongin-si (KR)

(72) Inventors: Si Duk Sung, Yongin-si (KR); Dae Sik Lee, Yongin-si (KR); Sang Hyun Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/081,427

(22) Filed: Oct. 27, 2020

(65) Prior Publication Data

US 2021/0209989 A1 Jul. 8, 2021

(30) Foreign Application Priority Data

Jan. 2, 2020 (KR) ..... 10-2020-0000511

(51) Int. Cl.
*G09G 3/3208* (2016.01)
*G09G 3/20* (2006.01)

(52) U.S. Cl.
CPC ..... *G09G 3/20* (2013.01); *G09G 2300/043* (2013.01); *G09G 2300/0842* (2013.01); *G09G 2310/06* (2013.01); *G09G 2330/022* (2013.01)

(58) Field of Classification Search
CPC ..... G09G 2330/00; G09G 3/3208; G09G 3/3275; G09G 2300/043; G09G 3/3235; G09G 3/3283; G09G 3/3291
See application file for complete search history.

(56) References Cited

U.S. PATENT DOCUMENTS 9,990,888 B2 6/2018 Oh et al.
10,380,947 B2 8/2019 Fujii et al.
2014/0353616 A1* 12/2014 Park ..... G09G 3/3233 438/34
2015/0138183 A1* 5/2015 Kishi ..... H01L 27/1225 345/214
2016/0189629 A1* 6/2016 Jin ..... G09G 3/3233 345/211

(Continued)

FOREIGN PATENT DOCUMENTS

KR 1020160027534 A 3/2016
KR 1020170055067 A 5/2017

(Continued)

*Primary Examiner* — Dennis P Joseph
(74) *Attorney, Agent, or Firm* — CANTOR COLBURN LLP

(57) ABSTRACT

A display device includes a display panel including a plurality of pixels, a scan driver which supplies scan signals and sensing control signals to scan lines and sensing control lines, based on a clock signal, a power manager which applies initialization power to initialization lines, a sensor which senses threshold voltages of driving transistors, a detector which detects an error of the initialization lines and outputs line information indicating an initialization line having the error, a timing controller which changes a sensed threshold voltage using the initialization line having the error and generates image data with reference to a changed threshold voltage, and a data driver which supplies a data signal corresponding to the image data to data lines.

20 Claims, 10 Drawing Sheets

(56) References Cited

U.S. PATENT DOCUMENTS

| | | | | |
|---|---|---|---|---|
| 2020/0184902 | A1* | 6/2020 | Kim | G09G 3/3291 |
| 2020/0193918 | A1* | 6/2020 | Hwang | G09G 3/3266 |
| 2020/0219448 | A1* | 7/2020 | Okamoto | G09G 3/3258 |

FOREIGN PATENT DOCUMENTS

| | | | |
|---|---|---|---|
| KR | 1020170080337 | A | 7/2017 |
| KR | 1020180036298 | A | 4/2018 |
| KR | 1020180125102 | A | 11/2018 |
| KR | 101960788 | B1 | 3/2019 |
| KR | 101965787 | B1 | 4/2019 |
| KR | 101991874 | B1 | 6/2019 |

* cited by examiner

<DISPLAY PERIOD>

DISPLAY DEVICE AND METHOD OF DRIVING THE SAME

This application claims priority to Korean Patent Application No. 10-2020-0000511, filed on Jan. 2, 2020, and all the benefits accruing therefrom under 35 U.S.C. § 119, the content of which in its entirety is herein incorporated by reference.

BACKGROUND

1. Field

Exemplary embodiments of the invention relate to a display device and a method of driving the display device.

2. Description of Related Art

With a development of information technology, an importance of a display device that is a connection medium between a user and information has been emphasized. Due to the importance of the display device, a use of various display devices such as a liquid crystal display device, an organic light-emitting display device, and a plasma display device has increased.

Pixels of the display device may each emit light of luminance corresponding to data voltages supplied through corresponding data lines. The display device may display an image frame by a light emission combination of the pixels.

The pixels may be coupled to the corresponding data lines. Thus, a scan driver that provides a scan signal for selecting a pixel to which a data voltage is to be supplied among the pixels is desired. The scan driver is provided in a form of a shift register to sequentially provide a turn-on level scan signal on a scan-line basis.

Furthermore, the scan driver provides a sensing control signal that senses a threshold voltage for a driving transistor of the pixel, and applies an initialization voltage depending on initialization power to the pixel in a sensing process.

SUMMARY

Exemplary embodiments of the invention are directed to a display device that detects an error of initialization lines to which initialization power is applied, changes a threshold voltage for a driving transistor sensed through an initialization line in which the error is detected, and supplies a data signal capable of compensating for the threshold voltage for the driving transistor of a pixel to the pixel.

Furthermore, exemplary embodiments of the invention are directed to a method of driving the display device.

However, features of the invention are not limited to the above-described objects, and various modifications are possible without departing from the spirit and scope of the invention.

An exemplary embodiment of the invention provides a display device. The display device includes a display panel including a plurality of pixels, a scan driver which supplies scan signals and sensing control signals to scan lines and sensing control lines coupled to the plurality of pixels, based on a clock signal, a power manager which applies initialization power to initialization lines coupled to the plurality of pixels, a sensor which senses threshold voltages of driving transistors included in the plurality of pixels using the initialization power, a detector which detects an error of each of the initialization lines, and outputs line information indicating an initialization line in which the error is detected, among the initialization lines, a timing controller which changes a sensed threshold voltage using the initialization line in which the error is detected, based on the line information received from the detector and the threshold voltages, and generates image data with reference to a changed threshold voltage, and a data driver which supplies a data signal corresponding to the image data to data lines coupled to the plurality of pixels.

In an exemplary embodiment, the detector may detect the error of each of the initialization lines by sensing an initialization current output from a source of the initialization power, and may determine the initialization line in which the error is detected among the initialization lines, based on the clock signal.

In an exemplary embodiment, the detector may include a clock counter which counts the clock signal and outputs information of a horizontal line corresponding to the pixels in which the threshold voltages are sensed, and a comparator which compares the initialization current output from a source of the initialization power with a preset threshold value, determines whether the initialization current exceeds a preset range, and determines the initialization line in which the error is detected among the initialization lines, based on the information of the horizontal line.

In an exemplary embodiment, the scan driver may include an oxide semiconductor thin film transistor gate driver circuit ("OSG") driver which outputs scan clock signals, sensing control clock signals, and carry clock signals, using a start signal, a first clock signal, and a second clock signal, and a plurality of stages which outputs the scan signals and the sensing control signals, based on the scan clock signals, the sensing control clock signals, and the carry clock signals.

In an exemplary embodiment, the clock counter may count at least one of the first clock signal and the second clock signal and output the information of the horizontal line.

In an exemplary embodiment, the clock counter may count the scan clock signals, the sensing control clock signals, or the carry clock signals and output the information of the horizontal line.

In an exemplary embodiment, the timing controller may change the sensed threshold voltage from a pixel coupled to the initialization line in which the error is detected, based on a sensed threshold voltage from a pixel coupled to a preceding initialization line which precedes the initialization line in which the error is detected or a sensed threshold voltage from a pixel coupled to a subsequent initialization line which succeeds the initialization line in which the error is detected.

In an exemplary embodiment, the timing controller may change the sensed threshold voltage from a pixel coupled to the initialization line in which the error is detected, using an average value of a sensed threshold voltage from a pixel coupled to the preceding initialization line which precedes the initialization line in which the error is detected and a sensed threshold voltage from a pixel coupled to the subsequent initialization line which succeeds the initialization line in which the error is detected.

In an exemplary embodiment, the timing controller may change the sensed threshold voltage from a pixel coupled to the initialization line in which the error is detected, based on sensed threshold voltages from pixels coupled to at least two initialization lines among a plurality of preceding initialization lines or a plurality of subsequent initialization lines.

In an exemplary embodiment, the timing controller may change the sensed threshold voltage from the pixel coupled to the initialization line in which the error is detected, using an average value or a median value of sensed threshold voltages from pixels coupled to at least two initialization lines among a plurality of preceding initialization lines or a plurality of subsequent initialization lines.

In an exemplary embodiment, each of the plurality of pixels may include a first transistor coupled between a first power source and a second node, and including a gate electrode coupled to a first node, a second transistor coupled between one of the data lines and the first node, and including a gate electrode coupled to one of the scan lines, a third transistor coupled between the second node and a third node, and including a gate electrode coupled to one of the sensing control lines, a storage capacitor coupled between the first node and the second node, and a light emitting element including a first electrode coupled to the second node, and a second electrode coupled to a second power source.

In an exemplary embodiment, the display panel may further include a first sensing capacitor coupled between the third node and a ground, and the sensor may include a second switch coupled between a sensing line coupled to the third node and a fourth node, a second sensing capacitor coupled between the fourth node and the ground, and an analog-digital converter including an input terminal coupled to the fourth node, and converting a voltage stored in the second sensing capacitor into a digital signal to output the digital signal.

In an exemplary embodiment, the third node may be coupled to the initialization line, the initialization line may be coupled to a source of the initialization power through the first switch, and the initialization power may be generated through an output terminal of an operational amplifier included in the power manager.

In an exemplary embodiment, when the first switch and the second switch are turned on, the second sensing capacitor may be initialized to an initialization voltage depending on the initialization power, and an initialization current output from the source of the initialization power may be temporarily discharged through the operational amplifier.

In an exemplary embodiment, when the first switch is turned off, a voltage of the second node may rise up to a differential voltage between a reference signal and the threshold voltage of the first transistor.

In an exemplary embodiment, the differential voltage may be divided depending on a capacitance ratio between the first sensing capacitor and the second sensing capacitor and charged in the second sensing capacitor.

An exemplary embodiment of the invention provides a method of driving a display device. The method includes sensing an initialization current output from a source of initialization power applied to initialization lines coupled to a plurality of pixels, determining whether the initialization current exceeds a preset range, determining an initialization line in which an error is detected among the initialization lines, in response to a determined result, changing a sensed threshold voltage from a pixel coupled to the initialization line in which the error is detected, and generating a data signal based on a changed threshold voltage.

In an exemplary embodiment, the plurality of pixels may be supplied with scan signals and sensing control signals through scan lines and sensing control lines coupled to the plurality of pixels, based on a clock signal, and determining the initialization line in which the error is detected may include generating information of a horizontal line corresponding to the pixel in which the threshold voltage is sensed, based on the clock signal, and determining the initialization line in which the error is detected, among the initialization lines, based on the information of the horizontal line.

In an exemplary embodiment, the scan signals and the sensing control signals may be supplied to the plurality of pixels based on scan clock signals, sensing control clock signals, and carry clock signals, and the scan clock signals, the sensing control clock signals, or the carry clock signals may be generated using a start signal, a first clock signal, and a second clock signal, and determining the initialization line in which the error is detected may include counting at least one of the first clock signal and the second clock signal and outputting the information of the horizontal line.

In an exemplary embodiment, the changing the threshold voltage may include changing the sensed threshold voltage from the pixel coupled to the initialization line in which the error is detected, based on a sensed threshold voltage from a pixel coupled to a preceding initialization line that precedes the initialization line in which the error is detected or a subsequent initialization line that succeeds the initialization line in which the error is detected.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
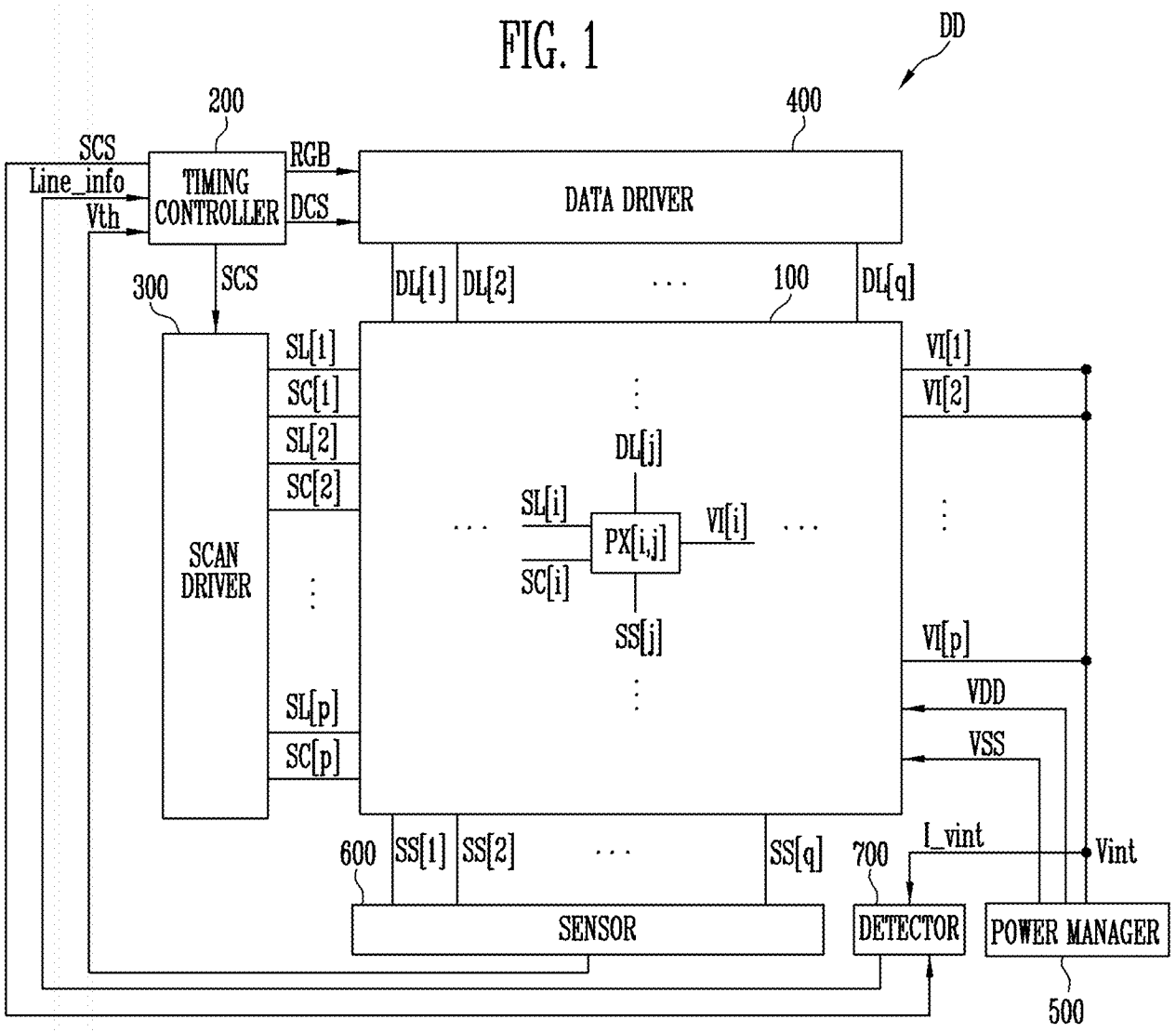
FIG. 1 is a diagram illustrating an exemplary embodiment of a display device in accordance with the invention.

Hereinafter, exemplary embodiments of the invention will be described in detail with reference to the attached drawings, such that those skilled in the art can easily implement the invention. Features of the invention may be implemented in various forms, and is not limited to exemplary embodiments to be described herein below.

In the drawings, portions which are not related to the invention will be omitted to explain the invention more clearly. Reference should be made to the drawings, in which similar reference numerals are used throughout the different drawings to designate similar components. Therefore, the aforementioned reference numerals may be used in other drawings.

For reference, the size of each component and the thicknesses of lines illustrating the component are arbitrarily expressed for the sake of explanation, and the invention is not limited to those illustrated in the drawings. In the drawings, the thicknesses of the components may be exaggerated to clearly express several layers and areas.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a diagram illustrating an exemplary embodiment of a display device in accordance with the invention.

Referring to FIG. 1, the display device DD may include a display panel 100, a timing controller 200, a scan driver 300, a data driver 400, a power manager 500, a sensor 600, and a detector 700.

The display panel 100 may include a plurality of pixels PX[i, j]. The pixels PX[i, j] may include p rows (p is a natural number) and q columns (q is a natural number). The pixels PX[i, j] disposed on the same row (hereinafter, also referred to as a horizontal line) may be coupled to the same scan line, the same sensing control line, and the same initialization line. Furthermore, the pixels PX[i, j] disposed on the same column (hereinafter, also referred to as a vertical line) may be coupled to the same data line. In an exemplary embodiment, the pixel PX[i, j] disposed on an i-th row (i is a natural number equal to or less than p) and a j-th column (j is a natural number equal to or less than q) may be coupled to an i-th scan line SL[i], an i-th sensing control line SC[i], and an i-th initialization line VI[i], and be coupled to a j-th data line DL[j] and a j-th sensing line SS[j], for example.

The timing controller 200 may generate a scan driving control signal SCS and a data driving control signal DCS in response to synchronization signals supplied from an external device. The scan driving control signal SCS may be supplied to the scan driver 300. The data driving control signal DCS may be supplied to the data driver 400. The timing controller 200 may rearrange input image data supplied from the external device to generate image data RGB and then supply the image data RGB to the data driver 400.

Figure 4:
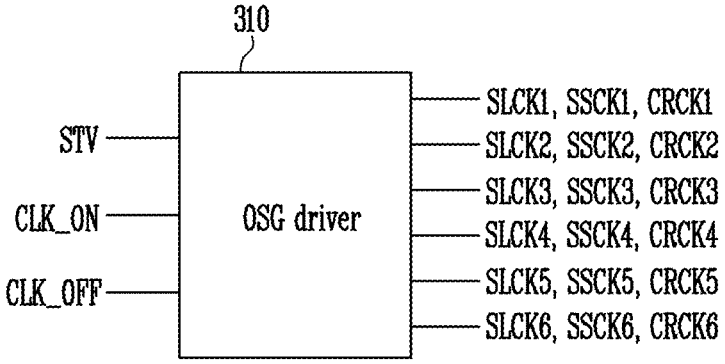
FIG. 4 is a conceptual diagram illustrating an exemplary embodiment of an oxide semiconductor thin film transistor gate driver circuit ("OSG") driver in accordance with the invention.

The scan driving control signal SCS may include a start signal STV (refer to FIG. 4), and clock signals (e.g. a first clock signal CLK_ON and a second clock signal CLK_OFF of FIG. 4). The start signal STV may be a signal for controlling the first timing of a scan signal.

The data driving control signal DCS may include a source start pulse and clock signals. The source start pulse may control a time at which the sampling of data starts. The clock signals may be used to control a sampling operation.

The scan driver 300 may receive the scan driving control signal SCS from the timing controller 200 and sequentially supply scan signals to scan lines SL[1], SL[2], . . . , SL[p] based on the scan driving control signal SCS. When the scan signals are sequentially supplied, the pixels PX[i, j] may be selected on a horizontal line basis (or a pixel row basis) and data signals may be supplied to the selected pixels PX[i, j].

Furthermore, the scan driver 300 may sequentially supply sensing control signals to sensing control lines SC[1], SC[2], . . . , SC[p] based on the scan driving control signal SCS. When the sensing control signals are sequentially supplied, the pixels PX[i, j] may be selected on the horizontal line basis (or pixel row basis), and characteristic information regarding the selected pixels PX[i, j] (e.g. threshold voltage of the driving transistor of the pixel PX[i, j], degradation of light emitting elements, etc.) may be sensed by the sensor 600.

The data driver 400 may receive the data driving control signal DCS and image data RGB from the timing controller 200. The data driver 400 may supply data signals to data lines DL[1], DL[2], . . . , DL[q] in response to the data driving control signal DCS. The data signals supplied to the data lines DL[1], DL[2], . . . , DL[q] may be supplied to the pixels PX[i, j] disposed on the horizontal line selected by the scan signal. To this end, the data driver 400 may supply the data signals to the data lines DL[1], DL[2], . . . , DL[q] in synchronization with the scan signals.

The power manager 500 may supply a voltage of first power VDD and a voltage of second power VSS to the display panel 100. Furthermore, the power manager 500 may generate an initialization power Vint and supply a voltage corresponding to the initialization power Vint to initialization lines VI[1], VI[2], . . . , VI[p]. Here, although the initialization lines VI[1], VI[2], . . . , VI[p] are illustrated as being disposed on one side of the display panel 100 (e.g., right side of the display panel 100 in FIG. 1), the initialization lines may be disposed on at least two sides of the display panel 100 (e.g., left and right sides of the display panel 100 in FIG. 1).

The source of the first power VDD and the source of the second power VSS may generate voltages for driving the light emitting element included in each pixel PX[i, j] of the display panel 100. In an exemplary embodiment, the voltage of the second power VSS may be lower than that of the first power VDD. In an exemplary embodiment, the voltage of the first power VDD may be a positive voltage, and the voltage of the second power VSS may be a negative voltage, for example.

The source of the initialization power Vint coupled (in common) to the initialization lines VI[1], VI[2], . . . , VI[p] may be the source of power that initializes each pixel PX[i, j] included in the display panel 100. In an exemplary embodiment, the driving transistor and/or the light emitting element included in the pixel PX[i, j] may be initialized by the voltage of the initialization power Vint, and the voltage of the initialization power Vint may be a negative voltage, for example.

The sensor 600 may sense a voltage or a current obtained from sensing lines SS[1], SS[2], . . . , SS[j] coupled to the pixels PX[i, j] included in the display panel 100, using the source of the initialization power Vint coupled to the initialization lines VI[1], VI[2], . . . , VI[p], may sense a threshold voltage Vth of the driving transistor included in each pixel PX[i, j] based on the sensed voltage or current, and may output the sensed threshold voltage Vth to the timing controller 200.

The detector 700 may detect the error of the initialization lines VI[1], VI[2], . . . , VI[p] by sensing an initialization current I_vint output from the source of the initialization power Vint generated in the power manager 500, and may supply line information Line_info indicating the initialization line in which the error is detected to the timing controller 200.

In an exemplary embodiment, the detector 700 may detect the error of the initialization lines VI[1], VI[2], . . . , VI[p], based on whether the initialization current I_vint exceeds a preset range, and may determine the initialization line in which the error is detected among the initialization lines VI[1], VI[2], . . . , VI[p], based on clock signals supplied from the timing controller 200, for example. The detector 700 may receive the scan driving control signal SCS from the timing controller 200, and may determine the initialization line in which the error is detected, by referring to clock signals and the start signal STV included in the received scan driving control signal SCS.

The timing controller 200 may generate the image data RGB based on the threshold voltage Vth received from the sensor 600 (or correcting the threshold voltage Vth), and may supply the generated image data RGB to the data driver 400. The data driver 400 may generate a data signal correcting the threshold voltage Vth based on the image data RGB received from the timing controller 200 (or changed based on the threshold voltage Vth), and then supply the data signal to the data lines DL[1], DL[2], . . . , DL[q].

Furthermore, the timing controller 200 may change information regarding the threshold voltage Vth of the pixels coupled to the initialization line in which the error is detected, by referring to the line information Line_info, and may correct (or generate) the image data RGB by referring to the changed information regarding the threshold voltage Vth.

Hereinafter, for the convenience of description, the pixel PX[i, j] disposed on the i-th row and the j-th column may be also referred to as the pixel PX[i, j], the scan line SL[i] corresponding to the i-th row may be also referred to as the scan line SL[i], the sensing control line SC[i] corresponding to the i-th row may be also referred to as the sensing control line SC[i], the data line DL[j] corresponding to the j-th column may be also referred to as the data line DLW, and the sensing line SS[j] corresponding to the j-th column may be also referred to as the sensing line SS[j].

Figure 2:
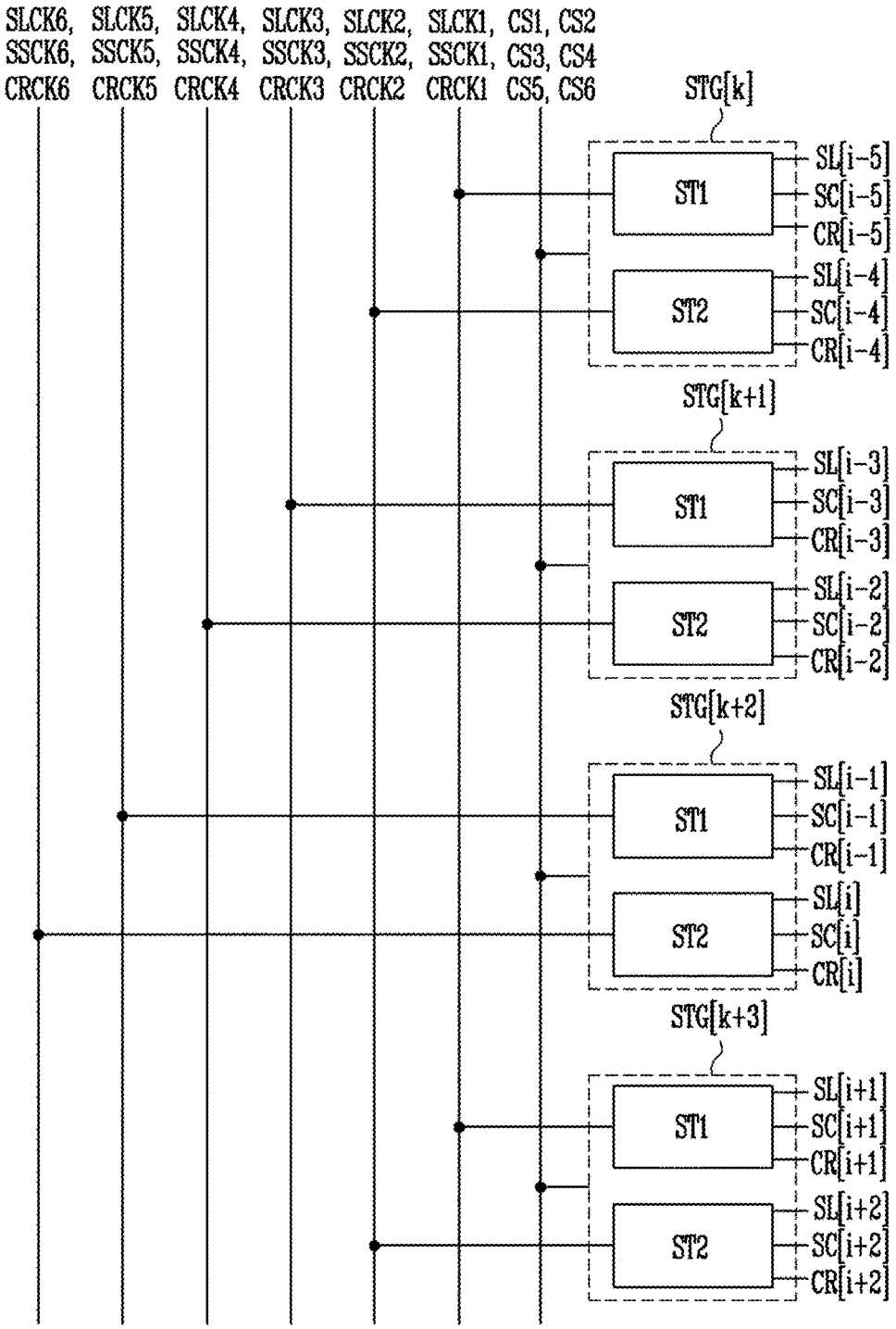
FIG. 2 is a diagram illustrating an exemplary embodiment of stages of a scan driver in accordance with the invention.

FIG. 2 is a diagram illustrating an exemplary embodiment of stages of the scan driver in accordance with the invention.

Although FIG. 2 illustrates stage groups coupled to scan lines and sensing control lines ranging from a scan line SL[i−5] and a sensing control line SC[i−5] corresponding to an i−5-th horizontal line to a scan line SL[i+2] and a sensing control line SC[i+2] corresponding to an i+2-th horizontal line from, those skilled in the art will expand and understand this configuration.

Referring to FIG. 2, the scan driver 300 may include a plurality of stage groups (e.g., STG[k], STG[k+1], STG[k+2], STG[k+3], . . . ). Each of the stage groups (e.g., STG[k], STG[k+1], STG[k+2], STG[k+3], . . . ) may include at least one stage. In an exemplary embodiment, each of the stage groups (e.g., STG[k], STG[k+1], STG[k+2], STG[k+3], . . . ) may include a first stage ST1 and a second stage ST2, for example.

The first stage ST1 may be a stage corresponding to an odd horizontal line, while the second stage ST2 may be a stage corresponding to an even horizontal line. In an alternative exemplary embodiment, the first stage ST1 may be a stage corresponding to an even horizontal line, while the second stage ST2 may be a stage corresponding to an odd horizontal line.

Each stage included in the multiple stage groups may be coupled to one of scan clock lines SLCK1, SLCK2, SLCK3, SLCK4, SLCK5, and SLCK6, one of sensing control clock lines SSCK1, SSCK2, SSCK3, SSCK4, SSCK5, and SSCK6, and one of carry clock lines CRCK1, CRCK2, CRCK3, CRCK4, CRCK5, and CRCK6. In an exemplary embodiment, the first stage ST1 included in the k+2-th (k is a natural number) stage group STG[k+2] may be coupled to the fifth scan clock line SLCK5, the fifth sensing control clock line SSCK5, and the fifth carry clock line CRCK5, for example. Furthermore, the second stage ST2 included in the stage group STG[k+2] may be coupled to the sixth scan clock line SLCK6, the sixth sensing control clock line SSCK6, and the sixth carry clock line CRCK6. Therefore, each stage may receive a scan clock signal through the scan clock line, receive a sensing control clock signal through the sensing control clock line, and receive a carry clock signal through the carry clock line. Each stage may output the scan signal according to the scan clock signal, output the sensing control signal according to the sensing control clock signal, and output the carry signal according to the carry clock signal.

Each stage included in the multiple stage groups may be coupled to at least one of control lines CS1, CS2, CS3, CS4, CS5, and CS6. In an exemplary embodiment, the first stage ST1 included in the stage group STG[k+2] may be coupled to the second control line CS2 and the fourth control line CS4 among the control lines CS1, CS2, CS3, CS4, CS5, and CS6, for example. Each stage may receive the control signal included in the scan control signal SCS from the timing controller 200 through at least one control line.

Each stage may be coupled to one of the scan lines (e.g., SL[1] to SL[p], one of the sensing control lines SC[1] to SC[p]), and one of carry lines (e.g., . . . , CR[i−5], CR[i−4], CR[i−3], CR[i−2], CR[i−1], CR[i], CR[i+1], CR[i+2], . . . ). The carry lines coupled to corresponding stages may be coupled to a preceding stage (or subsequent stage).

Each stage may supply the scan signal depending on the scan clock signal to the scan line, supply the sensing control signal depending on the sensing control clock signal to the sensing control line, and supply the carry signal depending on the carry clock signal to the carry line, in response to the control signal supplied through at least one control line and the carry signal supplied through the carry line of the stage included in a preceding stage group (or current stage group). In an exemplary embodiment, the second stage ST2 included in the stage group STG[k+2] may supply the scan signal to the scan line SL[i] corresponding to the i-th horizontal line, supply the sensing control signal to the sensing control line SC[i] corresponding to the i-th horizontal line, and supply the carry signal to the i-th carry line CR[i], for example. In this regard, the carry signal supplied to the i-th carry line CR[i] may be supplied to at least one of the stages included in the preceding stage group (e.g. STG[k+1] or STG[k]).

FIG. 2 illustrates that the first stage ST1 and the second stage ST2 included in each of the k-th stage group STG[k] (k is a natural number equal to or greater than one) to the k+3-th stage group STG[k+3] sequentially supply the scan signals to the scan line SL[i−5] corresponding to the i−5-th horizontal line to the scan line SL[i+2] corresponding to the i+2-th horizontal line.

Furthermore, it is illustrated that the first stage ST1 and the second stage ST2 included in each of the k-th stage group STG[k] (k is a natural number equal to or greater than one) to the k+3-th stage group STG[k+3] sequentially supply the sensing control signals to the sensing control line SC[i−5] corresponding to the i−5-th horizontal line to the sensing control line SC[i+2] corresponding to the i+2-th horizontal line.

Although FIG. 2 illustrates that six scan clock lines SLCK1, SLCK2, SLCK3, SLCK4, SLCK5, and SLCK6, six sensing control clock lines SSCK1, SSCK2, SSCK3, SSCK4, SSCK5, and SSCK6, and six carry clock lines CRCK1, CRCK2, CRCK3, CRCK4, CRCK5, and CRCK6 are sequentially coupled to the stages included in the multiple stage groups, respectively, the invention is not necessarily limited thereto.

Figure 3:
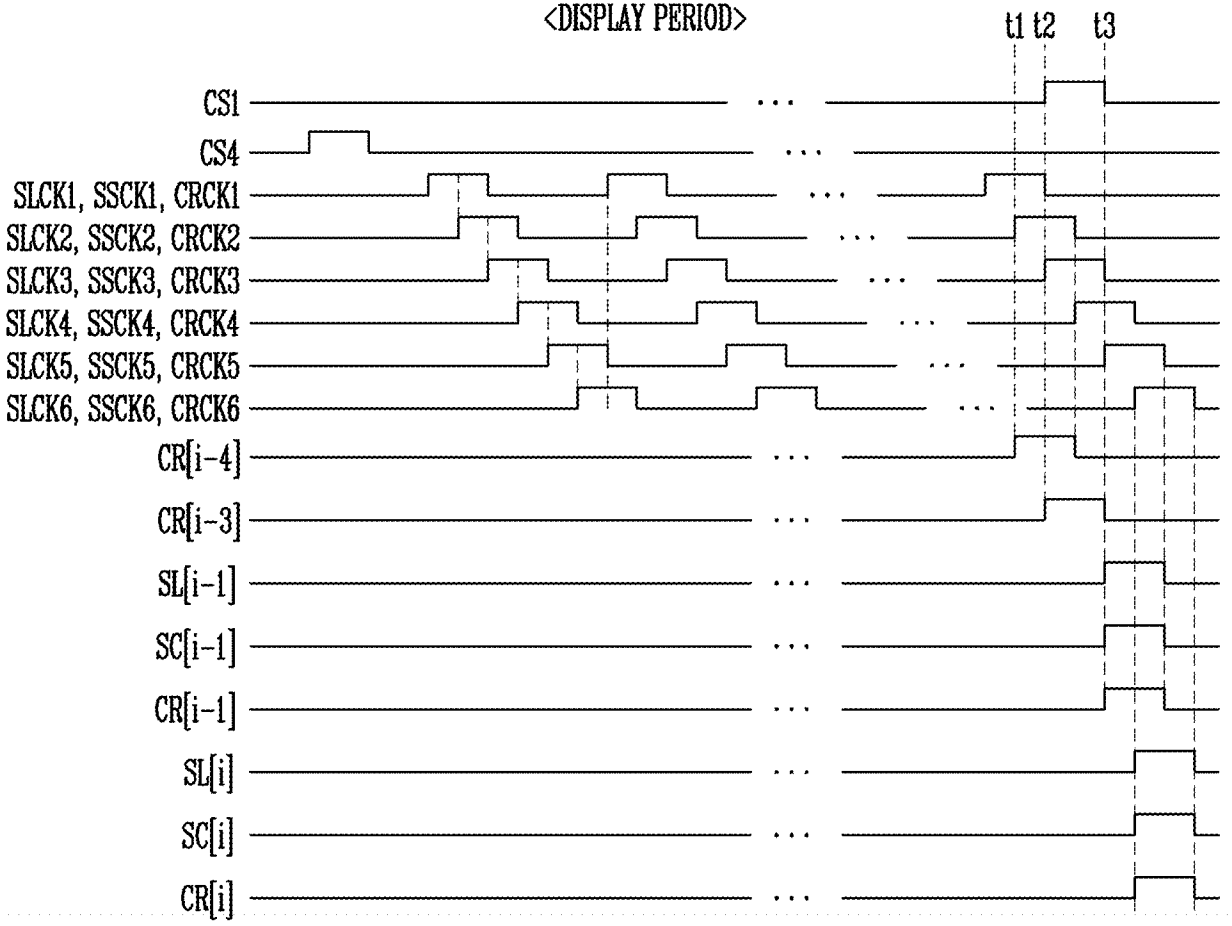
FIG. 3 is a waveform diagram illustrating an operation of the scan driver of FIG. 2.

FIG. 3 is a waveform diagram illustrating an operation of the scan driver of FIG. 2.

FIG. 3 illustrates output signals of lines SL[i−1], SC[i−1], CR[i−1], SL[i], SC[i], and CR[i] of the k+2-th stage group STG[k+2] shown in FIG. 2. Here, signals applied to the first control line CS1, the fourth control line CS4, the scan clock lines SLCK1 to SLCK6, the sensing control clock lines SSCK1 to SSCK6, the carry clock lines CRCK1 to CRCK6, the i−4-th carry line CR[i−4], and the i−3-th carry line CR[i−3] are input to the k+2-th stage group STG[k+2].

In a display period, the scan clock signal, the sensing control clock signal, and the carry clock signal applied to the scan clock line, the sensing control clock line, and the carry clock line, respectively, which are coupled to the same stage may have the same phase. For the convenience of description, although FIG. 3 illustrates signals applied to the scan clock lines SLCK1 to SLCK6, the sensing control clock lines SSCK1 to SSCK6, and the carry clock lines CRCK1 to CRCK6 in common, the invention is not necessarily limited thereto.

Furthermore, the scan clock signal, the sensing control clock signal, and the carry clock signal respectively applied to the scan clock line, the sensing control clock line, and the carry clock line which are coupled to the same stage may have different signal levels. Hereinafter, a voltage level corresponding to a gate-on voltage level is expressed as a high level, while a voltage level corresponding to a level of a first power source voltage or a second power source voltage is expressed as a low level.

Turning back to FIG. 3, high-level pulses applied to the second scan clock line SLCK2, the second sensing control clock line SSCK2, and the second carry clock line CRCK2 may be delayed in phase as compared to high-level pulses applied to the first scan clock line SLCK1, the first sensing control clock line SSCK1, and the first carry clock line CRCK1, but may be partially overlapped in time. In an exemplary embodiment, the high-level pulses may have the length of two horizontal periods, and the overlapping length may correspond to one horizontal period, for example.

Likewise, high-level pulses applied to the third scan clock line SLCK3, the third sensing control clock line SSCK3, and the third carry clock line CRCK3 may be delayed in phase as compared to high-level pulses applied to the second scan clock line SLCK2, the second sensing control clock line SSCK2, and the second carry clock line CRCK2, but may be partially overlapped in time. The same applies to the remaining scan clock lines SLCK4 to SLCK6, sensing control clock lines SSCK4 to SSCK6, and carry clock lines CRCK4 to CRCK6.

Hereinafter, the operation of the k+2-th stage group STG[k+2] of FIG. 2 in the display period will be described. Since the operation of the other stage groups of FIG. 2 is similar to that of the k+2-th stage group STG[k+2], a duplicated description thereof will be omitted.

First, after the high-level pulse is applied to the fourth control line CS4 and a predetermined time has passed, a high-level pulse may be applied to the i−4-th carry line CR(i−4) at a first time t1, and a high-level pulse may be generated in the first control line CS1 and the i−3-th carry line CR[i−3] at a second time t2. Here, signals applied to the respective control lines may be signals that control the output of the respective stages.

Next, at a third time t3, in response to the high-level pulse generated in the fifth scan clock line SLCK5, the fifth sensing control clock line SSCK5, and the fifth carry clock line CRCK5, the high-level pulse is output to the scan line SL[i−1], the sensing control line SC[i−1], and the carry line CR[i−1] corresponding to the i−1-th horizontal line.

In a similar manner, in response to the high-level pulse generated in the sixth scan clock line SLCK6, the sixth sensing control clock line SSCK6, and the sixth carry clock line CRCK6, the high-level pulse is output to the scan line SL[i], the sensing control line SC[i], and the carry line CR[i] corresponding to the i-th horizontal line.

Here, since the control signals applied to the control lines CS1 and CS4 and the carry signals CR[i−4] and CR[i−3] output in the preceding stage may vary depending on the configuration of the stage circuit, the invention is not limited to the above-mentioned embodiment.

However, even when the configuration of the stage circuit is changed, the multiple stages included in the scan driver 300 sequentially output the scan signals, sensing control signals, and carry signals having the high-level pulse, in response to the high-level pulse of the multiple scan clock lines, the multiple sensing control clock lines, and the multiple carry clock lines.

Therefore, when the scan clock signals, the sensing control clock signals, and/or the carry clock signals applied to the multiple scan clock lines, the multiple sensing control clock lines, and the multiple carry clock lines are monitored, it may be seen that a signal (scan signal, sensing control signal and/or carry signal) currently output from the scan driver 300 is a signal corresponding to any horizontal line. In an exemplary embodiment, when the number of times of outputting the high-level pulse from at least one of the fifth scan clock line SLCK5, the fifth sensing control clock line SSCK5, and the fifth carry clock line CRCK5 in FIG. 3 is counted, it is possible to recognize a time point when the signals of lines SL[i−1], SC[i−1], and CR[i−1] corresponding to the i−1-th horizontal line are output, for example.

Figure 5:
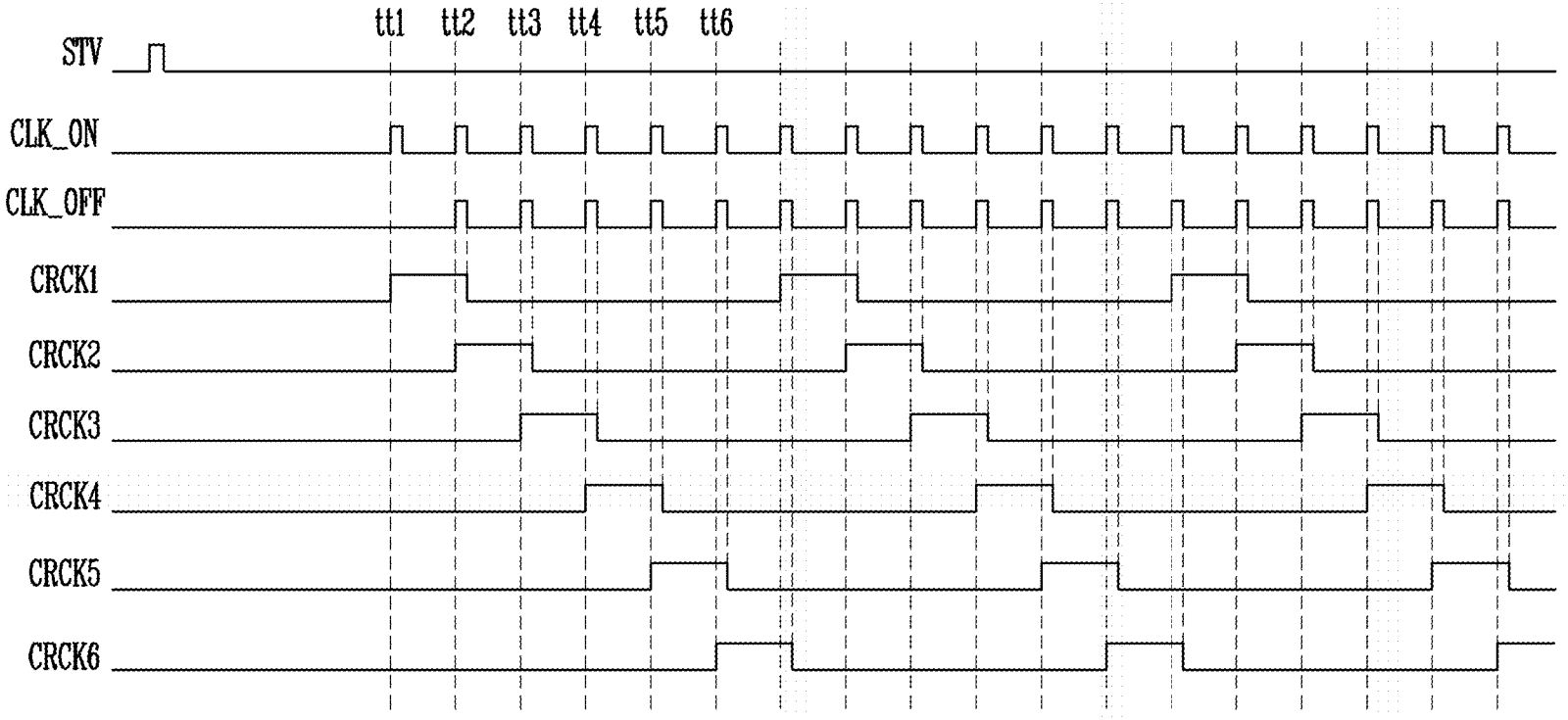
FIG. 5 is a waveform diagram illustrating an operation of the OSG driver of FIG. 4.

FIG. 4 is a conceptual diagram illustrating an exemplary embodiment of an oxide semiconductor thin film transistor gate driver circuit ("OSG") driver in accordance with the invention. FIG. 5 is a waveform diagram illustrating an operation of the OSG driver of FIG. 4.

Turning back to FIG. 3, each of the stages included in the scan driver 300 receives the scan clock signal through the scan clock line, receives the sensing control clock signal through the sensing control clock line, and receives the carry clock signal through the carry clock line.

Referring to FIG. 4, the OSG driver 310 may output multiple scan clock signals to multiple scan clock lines SLCK1 to SLCK6 using a start signal STV, a first clock signal CLK_ON, and a second clock signal CLK_OFF. In a similar manner, the OSG driver 310 may output multiple sensing control clock signals to multiple sensing control clock lines SSCK1 to SSCK6 using the start signal STV, the first clock signal CLK_ON, and the second clock signal CLK_OFF. The OSG driver 310 may output multiple carry clock signals to multiple carry clock lines CRCK1 to CRCK6 using the start signal STV, the first clock signal CLK_ON, and the second clock signal CLK_OFF.

In an exemplary embodiment, the OSG driver 310 may be disposed (e.g., mounted) on a non-display area of the display panel 100 in the form of the OSG through a thin-film process. In an alternative exemplary embodiment, in an exemplary embodiment, the OSG driver 310 may be disposed (e.g., mounted) on the display panel 100 in the form of a drive integrated circuit ("IC"). However, this is only for illustrative purposes, but at least a part of configuration or function of the OSG driver 310 may be included in the timing controller 200.

Although FIG. 4 illustrates that the multiple scan clock signals, the multiple sensing control clock signals, and the multiple carry clock signals are output using the first clock signal CLK_ON and the second clock signal CLK_OFF for the convenience of description, the invention is not necessarily limited thereto. In an exemplary embodiment, the OSG driver 310 may receive a first clock signal for outputting the multiple scan clock signals, a first clock signal for outputting the multiple sensing control clock signals, and a first clock signal for outputting the multiple carry clock signals, for example. Furthermore, the OSG driver 310 may receive a second clock signal for outputting the multiple scan clock signals, a second clock signal for outputting the multiple sensing control clock signals, and a second clock signal for outputting the multiple carry clock signals.

FIG. 5 illustrates that the OSG driver 310 outputs the multiple carry clock signals through the multiple carry clock lines CRCK1 to CRCK6, as the start signal STV is input into the OSG driver 310. Although FIG. 5 illustrates the process in which the multiple carry clock signals are output, the same or similar method may be applied to the multiple scan clock signals or the multiple sensing control clock signals.

First, when the high-level start signal STV is applied to the OSG driver 310, the OSG driver 310 sequentially outputs the multiple carry clock signals to the multiple carry clock lines depending on the high-level pulse of the first clock signal CLK_ON and the second clock signal CLK_OFF.

First, at a first time tt1, in response to a rising edge of the first clock signal CLK_ON, the first carry clock signal is supplied to the first carry clock line CRCK1 (or changed from a low level to a high level). In response to a falling edge of the second clock signal CLK_OFF generated after the first time tt1, the supply of the first carry clock signal is stopped (or, the first carry clock signal is changed from the high level to the low level).

At a second time tt2, in response to the rising edge of the first clock signal CLK_ON, the second carry clock signal is supplied to the second carry clock line CRCK2 (or changed from the low level to the high level). In response to the falling edge of the second clock signal CLK_OFF generated after the second time tt2, the supply of the second carry clock signal is stopped (or, the second carry clock signal is changed from the high level to the low level).

Similarly, in response to the rising edge of the first clock signal CLK_ON at a third time tt3, the third carry clock signal is supplied to the third carry clock line CRCK3. In response to the falling edge of the second clock signal CLK_OFF generated after the third time tt3, the supply of the third carry clock signal is stopped. In response to the rising edge of the first clock signal CLK_ON at a fourth time tt4, the fourth carry clock signal is supplied to the fourth carry clock line CRCK4. In response to the falling edge of the second clock signal CLK_OFF generated after the fourth time tt4, the supply of the fourth carry clock signal is stopped. In response to the rising edge of the first clock signal CLK_ON at a fifth time tt5, the fifth carry clock signal is supplied to the fifth carry clock line CRCK5. In response to the falling edge of the second clock signal CLK_OFF generated after the fifth time tt5, the supply of the fifth carry clock signal is stopped. In response to the rising edge of the first clock signal CLK_ON at a sixth time tt6, the sixth carry clock signal is supplied to the sixth carry clock line CRCK6. In response to the falling edge of the second clock signal CLK_OFF generated after the sixth time tt6, the supply of the sixth carry clock signal is stopped.

Since the OSG driver 310 outputs the multiple carry clock signals to the multiple carry clock lines CRCK1 to CRCK6 using at least two clock signals CLK_ON and CLK_OFF, the number of pins of the clock signals coupled to the scan driver 300 may be reduced. Furthermore, as illustrated in FIG. 3, when the high-level pulses of the multiple carry clock signals, the multiple sensing control clock signals, or the multiple carry clock signals output from the OSG driver 310 are counted, it may be determined which horizontal line corresponds to signals currently output from the scan driver 300.

As in the operation of FIG. 5, since the multiple carry clock signals are output in response to the rising edge or the falling edge of at least two clock signals, it may be determined which horizontal line corresponds to the signals currently output from the scan driver 300, by counting the pulses of at least two clock signals input into the OSG driver 310.

Figure 6:
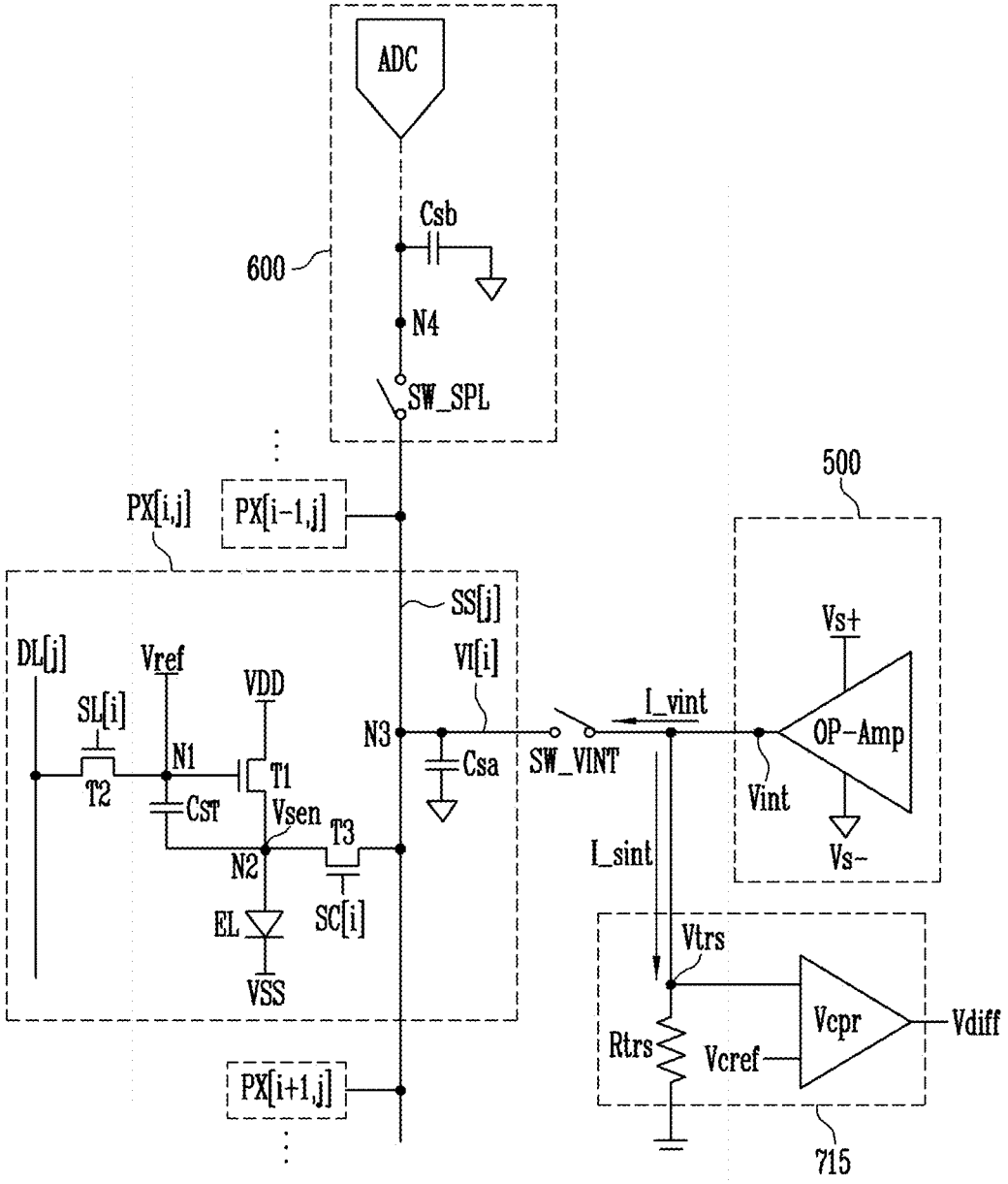
FIG. 6 is a diagram showing an exemplary embodiment of the configuration of a pixel and a sensor in accordance with the invention.

FIG. 6 is a diagram showing an exemplary embodiment of the configuration of a pixel and a sensor in accordance with the invention.

Referring to FIG. 6, the pixel PX[i, j] may include a first transistor T1, a second transistor T2, a third transistor T3, a storage capacitor Cst, and a light emitting element EL.

The first transistor T1 may be coupled between the source of first power VDD and a second node N2 corresponding to a first electrode of the light emitting element EL, and include a gate electrode coupled to a first node N1. Herein, the first transistor T1 may be also referred to as a driving transistor.

The second transistor T2 may be coupled between a data line DL[j] and the first node N1, and include a gate electrode coupled to a scan line SL[i]. When the scan signal is supplied through the scan line SL[i], the second transistor T2 may be turned on, and the data signal supplied through the data line DL[j] may be transmitted to the first node N1.

The third transistor T3 may be coupled between the second node N2 and a third node N3, and include a gate electrode coupled to a sensing control line SC[i]. When the sensing control signal is supplied through the sensing control line SC[i], the third transistor T3 may be turned on, and the second node N2 and the third node N3 may be electrically coupled to each other. Furthermore, the third node N3 may be coupled to a sensing line SS[j]. Thus, since a voltage Vsen applied to the second node N2 is transmitted to the sensing line SS[j], the sensor 600 may sense the voltage Vsen (or voltage applied to an anode electrode of the light emitting element EL) applied to the second node N2. The third transistor T3 may be also referred to as a sensing transistor.

The storage capacitor Cst may be coupled between the first node N1 and the second node N2. The storage capacitor Cst may charge a differential voltage between the voltage applied to the first node N1 and the voltage applied to the second node N2.

The light emitting element EL may include the first electrode (or anode electrode) coupled to the second node N2, and the second electrode (or cathode electrode) coupled to the source of second power VSS. The light emitting element EL may emit light having a luminance corresponding to a driving current supplied from the first transistor T1.

A first sensing capacitor Csa may be coupled between the third node N3 and the source of reference power (e.g. ground). The first sensing capacitor Csa may charge a voltage transmitted from the second node N2 to the third node N3 of the sensing line SS[j], thus transmitting the voltage to the sensor 600. The first sensing capacitor Csa may be included in the display panel 100.

Although each of the first transistor T1, the second transistor T2, and the third transistor T3 may be an n-type transistor, those skilled in the art will understand that it may be changed into a p-type transistor.

The third node N3 may be coupled to an initialization line VI[i], and the initialization line VI[i] may be coupled to the source of initialization power Vint through a first switch SW_VINT. Thus, the initialization voltage depending on the initialization power Vint may be applied through the initialization line VI[i] to the third node N3. When the first switch SW_VINT is turned on, the initialization voltage supplied to the third node N3 may be transmitted through the sensing line SS[j] to the second node N2.

The initialization power Vint may be generated as the output of an operational amplifier OP-Amp included in the power manager 500. In order to discharge a charging voltage of the third node N3 (or second node N2), an initialization current I_vint output from the source of the initialization power Vint may temporarily flow through the operational amplifier OP-Amp. In an exemplary embodiment, when a second switch SW_SPL is turned on with the first switch SW_VINT being turned on (a third period P3 of FIG. 7 that will be described later), the initialization current I_vint output from the source of the initialization power Vint may flow to the operational amplifier OP-Amp, for example. Such a flow of the initialization current may be referred to a current sinking. The invention is not necessarily implemented as the operational amplifier OP-Amp, but the power manager 500 may generate the initialization power Vint with the output of a forced continuous conduction mode ("FCCM") buck converter. Such a structure allows the initialization current I_vint to temporarily flow through the FCCM buck converter, thus discharging the charging voltage of the third node N3 or the second node N2. In an exemplary embodiment, a positive voltage Vs+ and a negative voltage Vs− may be input to input terminals of the operational amplifier OP-Amp.

The sensor 600 may include the second switch SW_SPL, the second sensing capacitor Csb, and an analog-digital converter ADC.

The second switch SW_SPL may be coupled between the sensing line SS[j] and a fourth node N4. The second sensing capacitor Csb may be coupled between the fourth node N4 and the ground. When the second switch SW_SPL is turned on, the second sensing capacitor Csb may be charged based on a ratio between a capacitance of the first sensing capacitor Csa and a capacitance of the second sensing capacitor Csb.

The analog-digital converter ADC may include an input terminal coupled to the fourth node N4, and convert the voltage stored in the second sensing capacitor Csb into a digital signal to output the digital signal.

The detector 700 of FIG. 1 may include a determiner 715 that senses the initialization current I_vint and determines whether the sensed initialization current I_vint exceeds a preset range. In an exemplary embodiment, the determiner 715 may convert a sensing current I_sint that is obtained by sensing the initialization current I_vint into a sensing voltage Vtrs, compare the converted sensing voltage Vtrs with a comparison reference voltage Vcref, and then output a comparison signal Vdiff, for example.

Here, the comparison signal Vdiff may be generated as the output of a differential amplifier Vcpr between the sensing voltage Vtrs and the comparison reference voltage Vcref, but the invention is not necessarily limited thereto. In an exemplary embodiment, the comparison signal Vdiff may include an output signal generated by comparing the sensing voltage Vtrs with the comparison reference voltage Vcref using various types of voltage comparators, for example. Here, the sensing current I_sint may be converted into the sensing voltage Vtrs using conversion resistance Rtrs coupled between the source of the initialization power Vint and the ground (or virtual ground). This is just an example but other types of current-voltage converters may be used.

Although FIG. 6 illustrate that the sensing current I_sint is obtained from an output terminal of the operational amplifier OP-Amp of the power manager 500, the invention is not necessarily limited thereto. In other words, the sensing current I_sint may be obtained from at least one of the nodes coupled to the multiple transistors forming the operational amplifier OP-Amp.

The detector 700 may determine whether the initialization current I_vint exceeds a preset range based on the comparison signal Vdiff, and then determine the initialization line in which the error is detected among the initialization lines, depending on the determined result. The detailed configuration of the detector 700 will be described in detail with reference to FIG. 9.

Figure 7:
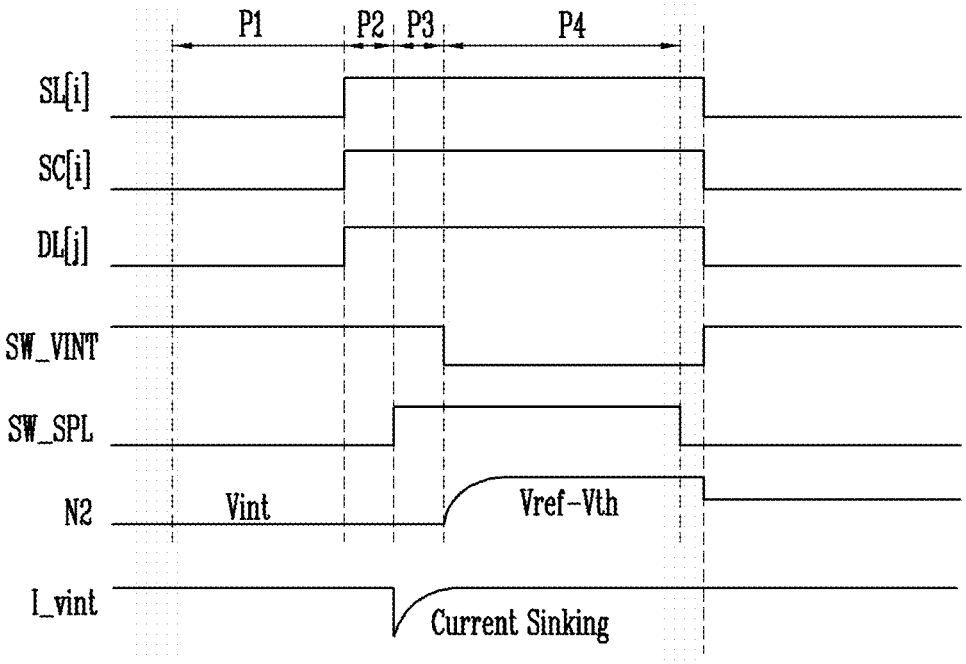
FIG. 7 is a waveform diagram illustrating a process of sensing a threshold voltage of a driving transistor included in the pixel by the sensor of FIG. 6.

FIG. 7 is a waveform diagram illustrating a process of sensing a threshold voltage of a driving transistor included in the pixel by the sensor of FIG. 6.

In FIG. 7, there is illustrated an operational waveform for a period when the sensor 600 of FIG. 6 senses the threshold voltage Vth of the driving transistor included in the pixel PX[i, j].

First, in a first period P1, the first switch SW_VINT may be in a turn-on state. Thus, the initialization voltage depending on the initialization power Vint generated by the power manager 500 may be applied to the third node N3, and the first sensing capacitor Csa coupled to the third node N3 may be initialized to the initialization voltage.

In a second period P2, as the scan signal is supplied through the scan line SL[i], the second transistor T2 is turned on. In this case, the reference signal Vref is in synchronization with the scan signal and supplied through the data line DL[j]. The reference signal Vref is applied to the gate electrode of the first transistor T1. Furthermore, as the sensing control signal is supplied through the sensing control line SC[i], the third transistor T3 may be turned on, and the initialization voltage applied to the third node N3 may be transmitted to the second node N2. The reference signal Vref may be a preset voltage for sensing the threshold voltage Vth of the driving transistor.

That is, in the second period P2, the reference signal Vref is applied to the gate electrode of the first transistor T1 (or the first node N1), and the initialization voltage is applied to the source electrode (or the second node N2). Thus, the differential voltage between the voltage depending on the reference signal Vref and the initialization voltage is charged in the storage capacitor Cst.

In a third period P3, as the second switch SW_SPL is turned on, the second sensing capacitor Csb may be initialized to the initialization voltage. Furthermore, when the second switch SW_SPL is turned on, the charging voltage of the third node N3 (or the second node N2) may be discharged. Thus, the initialization current I_vint may flow through the operational amplifier OP-amp included in the power manager 500.

In a fourth period P4, as the first switch SW_VINT is turned off, the voltage of the second node N2 (or the source electrode of the first transistor T1) may rise up to the differential voltage Vref−Vth between the reference signal Vref and the threshold voltage Vth of the first transistor T1. In this case, the differential voltage Vref−Vth applied to the second node N2 may be transmitted to the second sensing capacitor Csb depending on a capacitance ratio between the first sensing capacitor Csa and the second sensing capacitor Csb. Furthermore, when the voltage of the second node N2 rises up to the differential voltage Vref−Vth, the first transistor T1 is turned off, so that the voltage of the second node N2 is not increased any more. The voltage transmitted to the second sensing capacitor Csb is output in the form of a digital signal through the analog-digital converter ADC.

Therefore, the sensor 600 may acquire the differential voltage Vref−Vth from the digital signal based on the capacitance ratio between the first sensing capacitor Csa and the second sensing capacitor Csb, and may obtain the threshold voltage Vth and/or variance of the threshold voltage Vth by subtracting the differential voltage Vref−Vth from the reference signal Vref.

In an exemplary embodiment of the invention, when the threshold voltage Vth for the driving transistor of each pixel PX[i, j] is obtained, the second node N2 is initialized to the initialization voltage depending on the initialization power Vint. Thus, when the initialization line VI[i] coupled to the pixel PX[i, j] has a problem, the threshold voltage Vth acquired by the sensor 600 may contain an error.

When the threshold voltage Vth acquired by the sensor 600 has the error, the threshold voltage Vth cannot be precisely compensated, so that external compensation performance for a change of the pixel characteristics is degraded.

In order to solve the problem, in an exemplary embodiment of the invention, a method of improving the external compensation performance is proposed by detecting the error of the initialization lines VI[1], VI[2], . . . , VI[p] coupled to the multiple pixels of the display panel 100, determining (or specifying) the line having the error among the initialization lines, and determining (or changing) the threshold voltage Vth sensed through the initialization line in which the error is detected based on the threshold voltage Vth sensed through the initialization line having no error.

Figure 8:
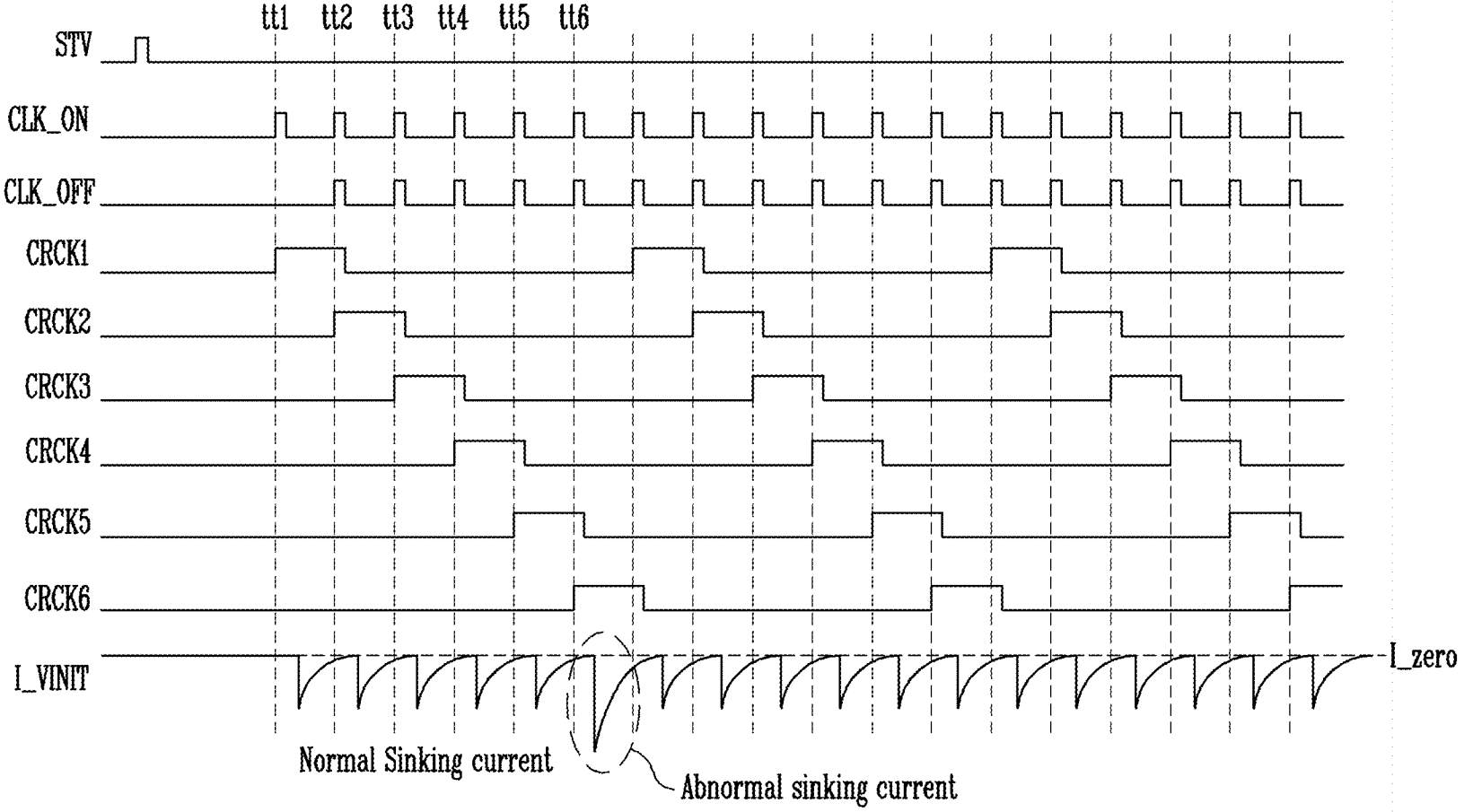
FIG. 8 is a waveform diagram illustrating an exemplary embodiment of a relationship between output signals of the OSG driver and an initialization current in accordance with the invention.

FIG. 8 is a waveform diagram illustrating an exemplary embodiment of a relationship between output signals of the OSG driver and an initialization current in accordance with the invention.

Components common to the waveform diagram of FIG. 8 and that of FIG. 5 will not be repeatedly described.

As described with reference to FIG. 7, the initialization voltage may be supplied to the pixel PX[i, j] coupled to one of the initialization lines VI[1], VI[2], . . . , VI[i], and the reference signal Vref may be supplied to the pixel PX[i, j].

Since the initialization voltage depending on the initialization power Vint is transmitted to the third node N3 or the second node N2, the initialization current I_vint may be equal to the reference current I_zero for the most of periods. In an exemplary embodiment, the reference current I_zero may be 0 [A] (i.e. the initialization current I_vint may be interpreted as a current waveform flowing in a negative direction (the direction opposite to the direction shown in FIG. 6), for example.

In the third period P3 of FIG. 7, as the voltage of the third node N3 (or the voltage of the second node N2) is discharged, the current sinking in which the initialization current I_vint flows into the power manager 500 may occur.

When the initialization line has various errors such as a short, the initialization current I_vint is abnormally increased as illustrated in FIG. 8. Thus, when the initialization current I_vint is abnormally increased (in the case of an abnormal sinking current or an overcurrent), it may be determined that the initialization line which is currently supplied with the initialization voltage has an error. In an exemplary embodiment, when the initialization current I_vint (or the intensity of the initialization current I_vint) exceeds a preset range, it may be determined that the initialization line which is currently supplied with the initialization voltage has an error, for example.

Even though it is confirmed that the initialization lines VI[1], VI[2], . . . , VI[i]) have an error, it is necessary to specify which initialization line has the error. To this end, in the invention, a correlation between the horizontal lines and the clock signals described above with reference to FIGS. 2 to 5 may be utilized.

In an exemplary embodiment, referring to FIG. 8, it may be seen that, as the multiple carry clock signals CRCK1 to CRCK6 are sequentially output as the high-level pulse, the initialization current I_vint is repeatedly lowered, for example.

Here, the multiple carry clock signals CRCK1 to CRCK6 may become reference signals for determining the output of a stage corresponding to a specific horizontal line, as illustrated in FIG. 3. Therefore, it is possible to determine a horizontal line in which the scan signal is output, through the multiple carry clock signals CRCK1 to CRCK6.

Furthermore, as illustrated in FIG. 5, the multiple carry clock signals CRCK1 to CRCK6 are sequentially output in response to at least two clock signals CLK_ON and CLK_OFF input to the OSG driver 310.

Thus, it is possible to determine (or specify) the initialization line having the error among the initialization lines, by counting at least two clock signals CLK_ON and CLK_OFF input to the OSG driver 310.

Figure 9:
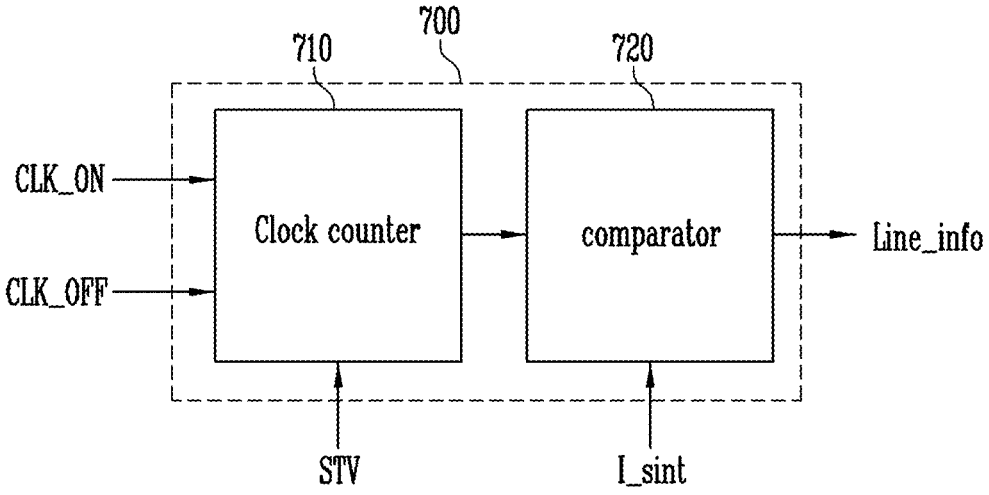
FIG. 9 is a block diagram illustrating the configuration of a detector of FIG. 1.

FIG. 9 is a block diagram illustrating the configuration of a detector of FIG. 1.

Referring to FIG. 9, the detector 700 may include a clock counter 710 and a comparator 720.

The clock counter 710 may count the pulses (e.g. high-level pulses) of at least two clock signals input into the OSG driver 310, and output the information of the horizontal line that currently outputs the scan signal (it may be the same as the information of the horizontal line corresponding to the initialization line to which the initialization voltage is currently applied) to the comparator 720. In this case, the clock counter 710 may receive the start signal STV, and start counting in response to the input start signal STV.

The comparator 720 may compare the initialization current I_vint with a preset threshold value, determine whether the initialization current I_vint exceeds a preset range, and determine the initialization line having the error among the initialization lines VI[1], VI[2], . . . , VI[i] based on the information of the horizontal line. For this operation, the comparator 720 may include the determiner 715 shown in FIG. 6. Therefore, the comparator 720 may determine whether the initialization current I_vint exceeds a preset range based on the comparison signal Vdiff that is the output of the determiner 715.

When the initialization current I_vint exceeds a preset range, the comparator 720 may output the information of the horizontal line received from the clock counter 170 as the line information Line_info. The line information Line_info may be information indicating the initialization line in which the error is detected. The comparator 720 may output the line information Line_info to the timing controller 200.

Figure 10:
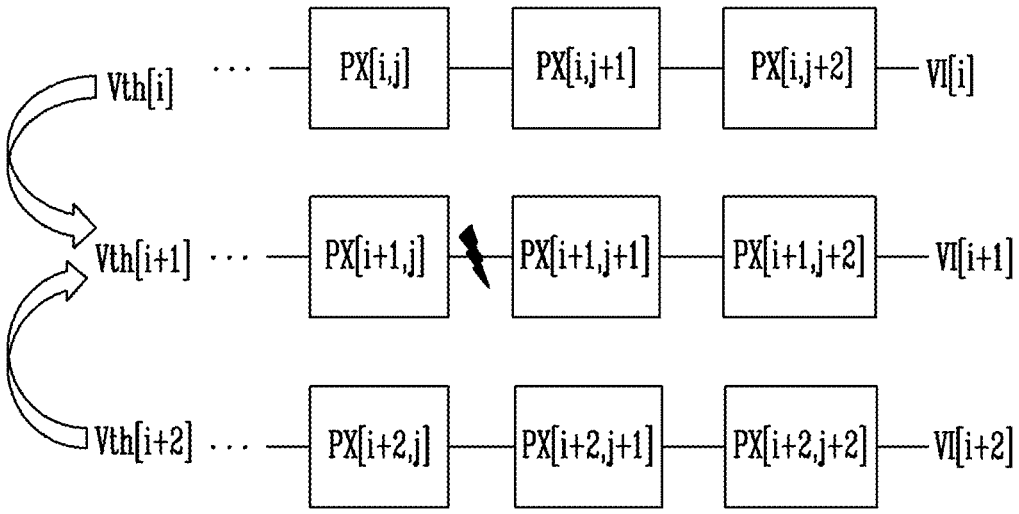
FIG. 10 is a conceptual diagram illustrating an exemplary embodiment of a method of changing a threshold voltage in a timing controller in accordance with the invention.

FIG. 10 is a conceptual diagram illustrating an exemplary embodiment of a method of changing a threshold voltage in a timing controller in accordance with the invention.

FIG. 10 illustrates a state in which the threshold voltages Vth[i], Vth[i+1], and Vth[i+2 are sensed through the initialization line VI[i] corresponding to the i-th horizontal line, the initialization line VI[i+1] corresponding to the i+1-th horizontal line, and the initialization line VI[i+2] corresponding to the i+2-th horizontal line, respectively.

Referring to FIG. 10, the initialization line VI[i+1] corresponding to the i+1-th horizontal line may be the initialization line having various errors such as a short. Thus, the error may be provided in the threshold voltage Vth[i+1] sensed from the pixels PX[i+1, j], PX[i+1, j+1], and PX[i+1, j+2] coupled to the initialization line VI[i+1] corresponding to the i+1-th horizontal line.

The timing controller 200 in an exemplary embodiment of the invention may change (or determine, compensate or replace) the threshold voltage Vth[i+1] sensed from the pixels PX[i+1, j], PX[i+1, j+1], and PX[i+1, j+2] coupled to the initialization line VI[i+1] having the error, using the threshold voltage Vth[i] sensed from the pixels PX[i, j], PX[i, j+1], and PX[i, j+2] coupled to the initialization line VI[i] preceding the initialization line VI[i+1] having the error and/or the threshold voltage Vth[i+2] sensed from the pixels PX[i+2, j], PX[i+2, j+1], and PX[i+2, j+2] coupled to the initialization line VI[i+2] succeeding the initialization line VI[i+1] having the error.

In an exemplary embodiment, the timing controller 200 may change the threshold voltage Vth[i+1] sensed from the pixels PX[i+1, j], PX[i+1, j+1], and PX[i+1, j+2] coupled to the initialization line VI[i+1] having the error, using an average value of the threshold voltage Vth[i] sensed from the pixels PX[i, j], PX[i, j+1], and PX[i, j+2] coupled to the preceding initialization line VI[i] and the threshold voltage Vth[i+2] sensed from the pixels PX[i+2, j], PX[i+2, j+1], and PX[i+2, j+2] coupled to the subsequent initialization line VI[i+2], for example.

In an exemplary embodiment, the timing controller 200 may change the threshold voltage Vth[i+1] sensed using the initialization line VI[i+1] having the error, using the threshold voltage Vth[i] sensed from the pixels PX[i, j], PX[i, j+1], and PX[i, j+2] coupled to the preceding initialization line VI[i] or the threshold voltage Vth[i+2] sensed from the pixels PX[i+2, j], PX[i+2, j+1], and PX[i+2, j+2] coupled to the subsequent initialization line VI[i+2], for example.

In an exemplary embodiment, the timing controller 200 may change the threshold voltage Vth[i+1] sensed from the pixel coupled to the initialization line VI[i+1] having the error, using the average value or median value of threshold voltages sensed from pixels coupled to preceding a (a is a natural number equal to or greater than 2) initialization lines, for example.

In an exemplary embodiment, the timing controller 200 may change the threshold voltage Vth[i+1] sensed from the pixel coupled to the initialization line VI[i+1] having the error, using the average value or median value of threshold voltages sensed from pixels coupled to subsequent b (b is a natural number equal to or greater than 2) initialization lines, for example.

In an exemplary embodiment, the timing controller 200 may change the threshold voltage Vth[i+1] sensed from the pixel coupled to the initialization line VI[i+1] having the error, using the average value or median value of threshold voltages sensed from pixels coupled to preceding a (a is a natural number equal to or greater than 2) initialization lines and subsequent b (b is a natural number equal to or greater than 2) initialization lines, for example.

After the threshold voltage Vth[i+1] sensed from the pixel coupled to the initialization line VI[i+1] having the error is changed, the timing controller 200 may compensate (or generate) image data RGB based on the changed threshold voltage Vth[i+1].

Figure 11:
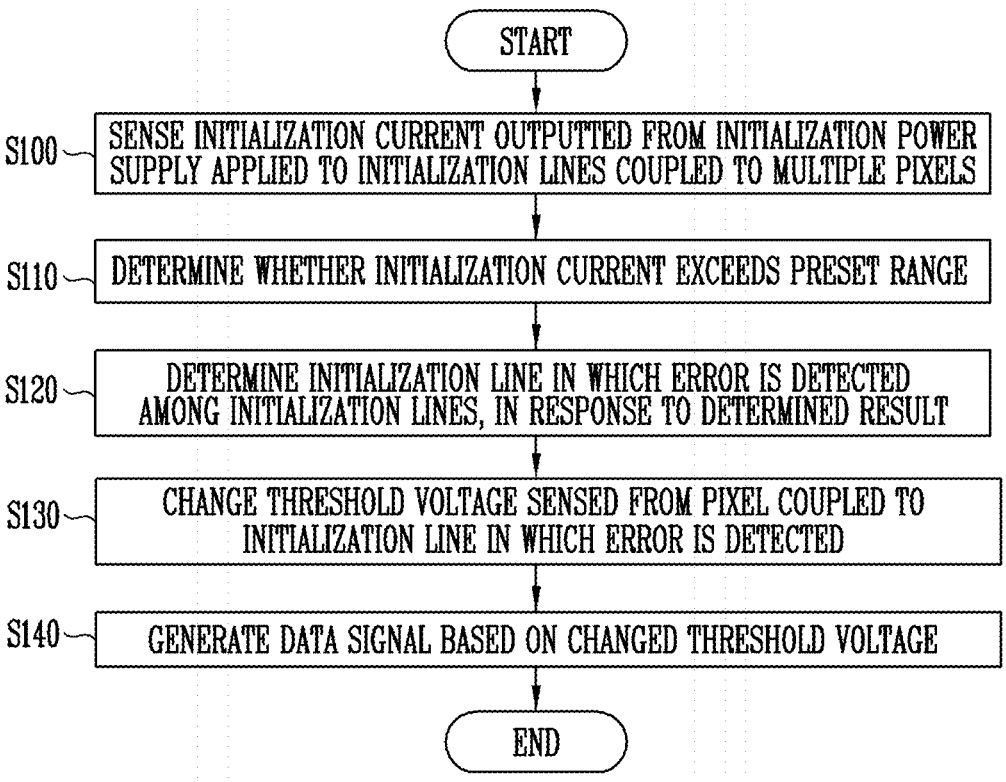
FIG. 11 is a flowchart illustrating an exemplary embodiment of a method of driving a display device in accordance with the invention.

FIG. 11 is a flowchart illustrating an exemplary embodiment of a method of driving a display device in accordance with the invention.

Referring to FIG. 11, the method of driving the display device may include an operation S100 of sensing an initialization current output from the source of initialization power applied to initialization lines coupled to multiple pixels, an operation S110 of determining whether the initialization current exceeds a preset range, an operation S120 of determining an initialization line in which an error is detected among the initialization lines, in response to the determined result, an operation S130 of changing a threshold voltage sensed from a pixel coupled to the initialization line in which the error is detected, and an operation S140 of generating a data signal based on the changed threshold voltage.

The multiple pixels may be supplied with scan signals and sensing control signals through scan lines and sensing control lines coupled to the multiple pixels, based on at least one clock signal.

The operation S120 of determining the initialization line in which the error is detected may generate information of a horizontal line corresponding to the pixel in which the threshold voltage is sensed, based on at least one clock signal, and may determine the initialization line in which the error is detected among the initialization lines, based on the generated information of the horizontal line.

The scan signals and the sensing control signals may be supplied to the multiple pixels based on scan clock signals, sensing control clock signals, and carry clock signals.

The scan clock signals, the sensing control clock signals, or the carry clock signals may be generated using a start signal, a first clock signal, and a second clock signal.

The operation S120 of determining the initialization line in which the error is detected may generate the information of the horizontal line by counting at least one of the first clock signal and the second clock signal.

The operation S130 of changing the threshold voltage may change the threshold voltage sensed from the pixel coupled to the initialization line in which the error is detected, based on a threshold voltage sensed from a pixel coupled to an initialization line preceding or succeeding the initialization line having the error.

In addition, it should be construed that an operation of each component of the display device described with reference to FIGS. 1 to 10 may be included in the method of driving the display device.

A display device and a method of driving the display device in accordance with the invention are advantageous in that it is possible to detect an error of an individual initialization line, which is not easily sensed because it is not displayed, and an initialization current output according to initialization power is monitored in a power manager, so that it is unnecessary to add an additional error detection circuit to a pixel.

Furthermore, a display device and a method of driving the display device in accordance with the invention are advantageous in that a threshold voltage sensed through an initialization line having a detected error is changed using a threshold voltage sensed through an initialization line having no error, so that it is possible to rapidly and quickly cope with even a small error of the initialization line.

The detailed description of the invention described with reference to the drawings is merely illustrative, which is used only for the purpose of describing the invention and is not used to limit the meaning or scope of the invention as defined in the accompanying claims. Therefore, those skilled in the art will understand that various modifications and equivalences thereof are possible. Accordingly, the bounds and scope of the invention should be determined by the technical spirit of the invention.

What is claimed is:

1. A display device, comprising:

a display panel including a plurality of pixels, each of the plurality of pixels including a first transistor, a light emitting element having an anode electrode connected to the first transistor, and a third transistor connected between the anode electrode and a branch node;

a scan driver which supplies scan signals and sensing control signals to scan lines and sensing control lines coupled to the plurality of pixels, based on a clock signal;

a power manager which supplies initialization power to initialization lines coupled to branch nodes of the plurality of pixels;

a first switch which selectively connects the power manager to the initialization lines;

a sensor which senses threshold voltages of the first transistors of the plurality of pixels through the branch nodes of the plurality of pixels after the branch nodes of the plurality of pixels are initialized by the initialization power, the sensor including a second switch which selectively connects the sensor to the branch nodes of the plurality of pixels;

a detector which detects a short of each of the initialization lines based on changes in initialization current flowing through the initialization lines when the second switch connects the sensor to the branch nodes of the plurality of pixels during the first switch connects the power manager to the initialization lines to initialize the branch nodes of the plurality of pixels, and outputs line information indicating an initialization line in which the short is detected, among the initialization lines;

a timing controller which changes a sensed threshold voltage using the initialization line in which the short is detected, based on the line information received from the detector and at least a portion of the threshold voltages, and generates image data with reference to a changed threshold voltage; and a data driver which supplies a data signal corresponding to the image data to data lines coupled to the plurality of pixels, wherein a start time point of a turn-on period of the second switch of the sensor which senses the threshold voltages of the first transistors is between a start time point and an end time point of a turn-on period of the first switch connected to the power manager which supplies the initialization power to the plurality of pixels through the initialization lines.

2. The display device according to claim 1, wherein the detector detects the short of each of the initialization lines by sensing the initialization current output from a source of the initialization power, and determines the initialization line in which the short is detected among the initialization lines, based on the clock signal.

3. The display device according to claim 2, wherein the detector comprises:

a clock counter which counts the clock signal and outputs information of a horizontal line corresponding to the plurality of pixels in which the threshold voltages are sensed; and a comparator which determines whether the initialization current exceeds a preset range by comparing the initialization current output from the source of the initialization power with a preset threshold value, and determines the initialization line in which the short is detected among the initialization lines, based on the information of the horizontal line.

4. The display device according to claim 3, wherein the scan driver comprises:

an oxide semiconductor thin film transistor gate driver circuit ("OSG") driver which outputs scan clock signals, sensing control clock signals, and carry clock signals, using a start signal, a first clock signal, and a second clock signal; and a plurality of stages which outputs the scan signals and the sensing control signals, based on the scan clock signals, the sensing control clock signals, and the carry clock signals.

5. The display device according to claim 4, wherein the clock counter counts at least one of the first clock signal and the second clock signal and outputs the information of the horizontal line.

6. The display device according to claim 4, wherein the clock counter counts the scan clock signals, the sensing control clock signals, or the carry clock signals and outputs the information of the horizontal line.

7. The display device according to claim 1, wherein the timing controller changes the sensed threshold voltage from a pixel coupled to the initialization line in which the short is detected among the plurality of pixels, based on a sensed threshold voltage from a pixel coupled to a preceding initialization line which precedes the initialization line in which the short is detected among the plurality of pixels or a sensed threshold voltage from a pixel coupled to a subsequent initialization line which succeeds the initialization line in which the short is detected among the plurality of pixels.

8. The display device according to claim 1, wherein the timing controller changes the sensed threshold voltage from a pixel coupled to the initialization line in which the short is detected among the plurality of pixels, using an average value of a sensed threshold voltage from a pixel coupled to a preceding initialization line which precedes the initialization line in which the short is detected among the plurality of pixels and a sensed threshold voltage from a pixel coupled to a subsequent initialization line which succeeds the initialization line in which the short is detected among the plurality of pixels.

9. The display device according to claim 1, wherein the timing controller changes the sensed threshold voltage from a pixel coupled to the initialization line in which the short is detected among the plurality of pixels, based on sensed threshold voltages from pixels coupled to at least two initialization lines among a plurality of preceding initialization lines or a plurality of subsequent initialization lines among the plurality of pixels.

10. The display device according to claim 1, wherein the timing controller changes the sensed threshold voltage from a pixel coupled to the initialization line in which the short is detected among the plurality of pixels, using an average value or a median value of sensed threshold voltages from pixels coupled to at least two initialization lines among a plurality of preceding initialization lines or a plurality of subsequent initialization lines among the plurality of pixels.

11. The display device according to claim 1, wherein:

the first transistor is coupled between a first power source and a second node, and comprising a gate electrode coupled to a first node;

the third transistor is coupled between the second node and the branch node, and comprises a gate electrode coupled to one of the sensing control lines; and the light emitting element comprises a cathode electrode coupled to a second power source, the anode electrode of the light emitting element being coupled to the second node, and wherein each of the plurality of pixels further comprises:

a second transistor coupled between one of the data lines and the first node, and comprising a gate electrode coupled to one of the scan lines;

a storage capacitor coupled between the first node and the second node.

12. The display device according to claim 11, wherein:

the display panel further comprises a first sensing capacitor coupled between the branch node and a ground, and the second switch is coupled between a sensing line coupled to the branch node and a fourth node;

the sensor further comprises a second sensing capacitor coupled between the fourth node and the ground; and an analog-digital converter which comprises an input terminal coupled to the fourth node, converts a voltage stored in the second sensing capacitor into a digital signal and outputs the digital signal.

13. The display device according to claim 12, wherein the branch node is coupled to the initialization line, the initialization line is coupled to a source of the initialization power through the first switch, and the initialization power is generated through an output terminal of an operational amplifier included in the power manager.

14. The display device according to claim 13, wherein, when the first switch and the second switch are turned on, the second sensing capacitor is initialized to an initialization voltage depending on the initialization power, and an initialization current output from the source of the initialization power is temporarily discharged through the operational amplifier.

15. The display device according to claim 13, wherein, when the first switch is turned off, a voltage of the second node rises up to a differential voltage between a reference signal and a threshold voltage of the first transistor.

16. The display device according to claim 15, wherein the differential voltage is divided depending on a capacitance ratio between the first sensing capacitor and the second sensing capacitor and charged in the second sensing capacitor.

17. A method of driving a display device comprising pixels, each of the pixels including a first transistor, a light emitting element having an anode electrode connected to the first transistor, and a third transistor connected between the anode electrode and a branch node, the method comprising:

outputting an initialization current from a source of initialization power to initialization lines coupled to branch nodes of the pixels when a first switch between the source of initialization power and the initialization lines connects the source of initialization power to the initialization lines;

sensing the initialization current;

determining whether the initialization current exceeds a preset range;

determining an initialization line in which a short is detected among the initialization lines, in response to a determined result;

sensing, by a sensor, a threshold voltage from the pixels when a second switch included in the sensor connects the sensor to the branch nodes of the pixels;

changing a sensed threshold voltage from a pixel coupled to the initialization line in which the short is detected among the pixels; and generating a data signal based on a changed threshold voltage, wherein the determining whether the initialization current exceeds the preset range is performed when the second switch connects the sensor to the branch nodes of the plurality of pixels during the first switch connects the power manager to the initialization lines to initialize the branch nodes of the plurality of pixels, and wherein a start time point of a turn-on period of the second switch of the sensor which senses the threshold voltage from the pixels is between a start time point and an end time point of a turn-on period of the first switch connected to the source of initialization power which supplies the initialization power to the pixel.

18. The method according to claim 17, wherein:

the pixels are supplied with scan signals and sensing control signals through scan lines and sensing control lines coupled to the pixels, based on a clock signal, and determining the initialization line in which the short is detected comprises generating information of a horizontal line corresponding to the pixel in which the threshold voltage is sensed, based on the clock signal, and determining the initialization line in which the short is detected, among the initialization lines, based on the information of the horizontal line.

19. The method according to claim 18, wherein:

the scan signals and the sensing control signals are supplied to the pixels based on scan clock signals, sensing control clock signals, and carry clock signals, the scan clock signals, the sensing control clock signals, or the carry clock signals are generated using a start signal, a first clock signal, and a second clock signal, and determining the initialization line in which the short is detected comprises counting at least one of the first clock signal and the second clock signal and outputting the information of the horizontal line.

20. The method according to claim 17, wherein the changing the sensed threshold voltage comprises:

changing the sensed threshold voltage from the pixel coupled to the initialization line in which the short is detected, based on a sensed threshold voltage from a pixel coupled to a preceding initialization line which precedes the initialization line in which the short is detected among the pixels or a sensed threshold voltage from a pixel coupled to a subsequent initialization line which succeeds the initialization line in which the short is detected among the pixels.

* * * * *